US005523985A

United States Patent [19]

Nixon

[11] Patent Number: 5,523,985

[45] Date of Patent: Jun. 4, 1996

[54] GOLF COURSE TIMER TO ALLEVIATE SLOW PLAY

[76] Inventor: Rodger Nixon, 1520 York Ave. #6D, New York, N.Y. 10028

[21] Appl. No.: 326,261

[22] Filed: Oct. 20, 1994

[51] Int. Cl.[6] ..... G04B 47/00

[52] U.S. Cl. ..... 368/107

[58] Field of Search ..... 368/10, 107–113

[56] References Cited

U.S. PATENT DOCUMENTS 4,303,243 12/1981 Wolf .
5,086,390 2/1992 Matthews .
5,097,416 3/1992 Matthews .
5,305,201 4/1994 Matthews .
5,335,212 8/1994 Bartos ..... 368/107
5,357,487 10/1994 Coleman ..... 368/108
5,386,990 2/1995 Smith ..... 368/97

*Primary Examiner*—Bernard Roskoski
*Attorney, Agent, or Firm*—Hoffman, Wasson & Gitler

[57] ABSTRACT

A watch-like timer is provided having a sweep hand and a dial with markings corresponding to eighteen holes. After the timer is started, the sweep hand rotates clockwise to provide the golfer with a continuous indication of where he or she should be on the golf course in order to complete the course in a specified period of time. Provision can be made for a break period, usually after the ninth hole.

18 Claims, 10 Drawing Sheets

*Rear View*

GOLF COURSE TIMER TO ALLEVIATE SLOW PLAY

BACKGROUND OF THE INVENTION

1. Field of the Invention

The present invention relates to a timer for use on a golf course to help keep golfers playing at a steady pace. More particularly, the present invention relates to a timer, which includes a watch-like device having a moving sweep hand and a dial showing eighteen course holes.

2. Description of the Prior Art

Golf as a sport and a recreation has been rapidly growing in popularity. As the number of golfers increased, the demand for time on the golf course has grown proportionally. While many groups of golfers can play on the same course simultaneously, the groups need a safe distance between them to protect golfers in one group from being hit by a ball from the group behind them.

If a group of golfers plays too slowly, they will create congestion on the course, which will lower optimum employment of the course by the greatest number of golfers.

Various ways and devices have been used to discourage slow play on the golf course. U.S. Pat. No. 4,303,243 to Wolfe relates to a system and method of timing golfers on a golf course. Timers are positioned at various intervals along a golf course, preferably at each tee. The timers each have a clock like mechanism and a dial bearing a set of numbered markings. The numbers denote separate groups of golfers. The dial is surrounded by a timing indicator which provides information about the speed of play of each group of golfers. The indicator has markings, such as "early," "on time," "late," and "very late." As the dial rotates the numbers, corresponding to the groups of golfers, move to indicate the relative speed of play of the groups.

While the Wolfe system does provide a way to give golfers information about their relative playing speed, it is not without drawbacks. First, since the timers are fixed in positions around the golf course, they are obviously not portable. Second, as a consequence of their lack of portability, golfers receive only periodic, not continuous, information about their playing speed. Third, the Wolfe system cannot accommodate large numbers of golfers. For example, a full course of golfers maintaining three minute intervals, completing a round of golf in four hours, would require eighty numbered positions on the disc of Wolfe. Fourth it is difficult and disruptive to readjust the timers during the course of a days use of the golf course. Fifth, the Wolfe timer does not provide a way to account for different size groups of golfers, weather conditions which slow down or speed up play, or golfers with special needs.

U.S. patents to Matthews (U.S. Pat. Nos. 5,305,201, 5,097,416, 5,086,390, and 4,303,243) relate to a system for monitoring play of golfers. The system is designed to increase the rate of play of golfers on a given golf course, and requires a series of transmitters and receivers to track the golfers on the course from a centralized location.

While the Matthews system does provide continuous information, it requires an elaborate and expensive system which also requires monitoring by marshals at the central location. Furthermore, Matthews does not give the golfers a visual indication of their playing speed, but rather, relies on the marshals to advise the golfers to slow down or speed up. Such a system of central monitoring has not been effective in the past.

SUMMARY OF THE INVENTION

The forgoing and other deficiencies of the prior art are addressed by the present invention which is directed to a watch-like timer having a sweep hand and a dial with markings corresponding to eighteen holes. After the timer is started, the sweep hand rotates clockwise to provide the golfer with a continuous indication of where he or she should be on the golf course in order to complete the course in a specified period of time. Provision can be made for a break period, usually after the ninth hole.

It is an object of the present invention to provide a timer that gives a golfer continuous indications of his or her speed of play relative to an optimum playing speed.

It is another object of the present invention to provide a timer which is portable and relatively inexpensive.

Yet another object of the present invention is to provide a timer which allows a golfer to take a break period from the course, the break period being adjustable.

Still another object of the present invention is to provide a golf timer that can accommodate groups of varying number s of golfers.

Another object of the invention is to provide a timer which can be adjusted to change the optimum playing time for a specified number of holes.

Still another object of the invention is to provide a golf timer which provides simultaneous indication of playing time and break time.

Another object of the invention is to provide a golf timer which displays an extra time period for a golfer or group of golfers.

BRIEF DESCRIPTION OF THE DRAWINGS

The foregoing objects and other attributes of the present invention will be described with respect to the following drawings in which.

DETAILED DESCRIPTION OF THE INVENTION

Figure 1:
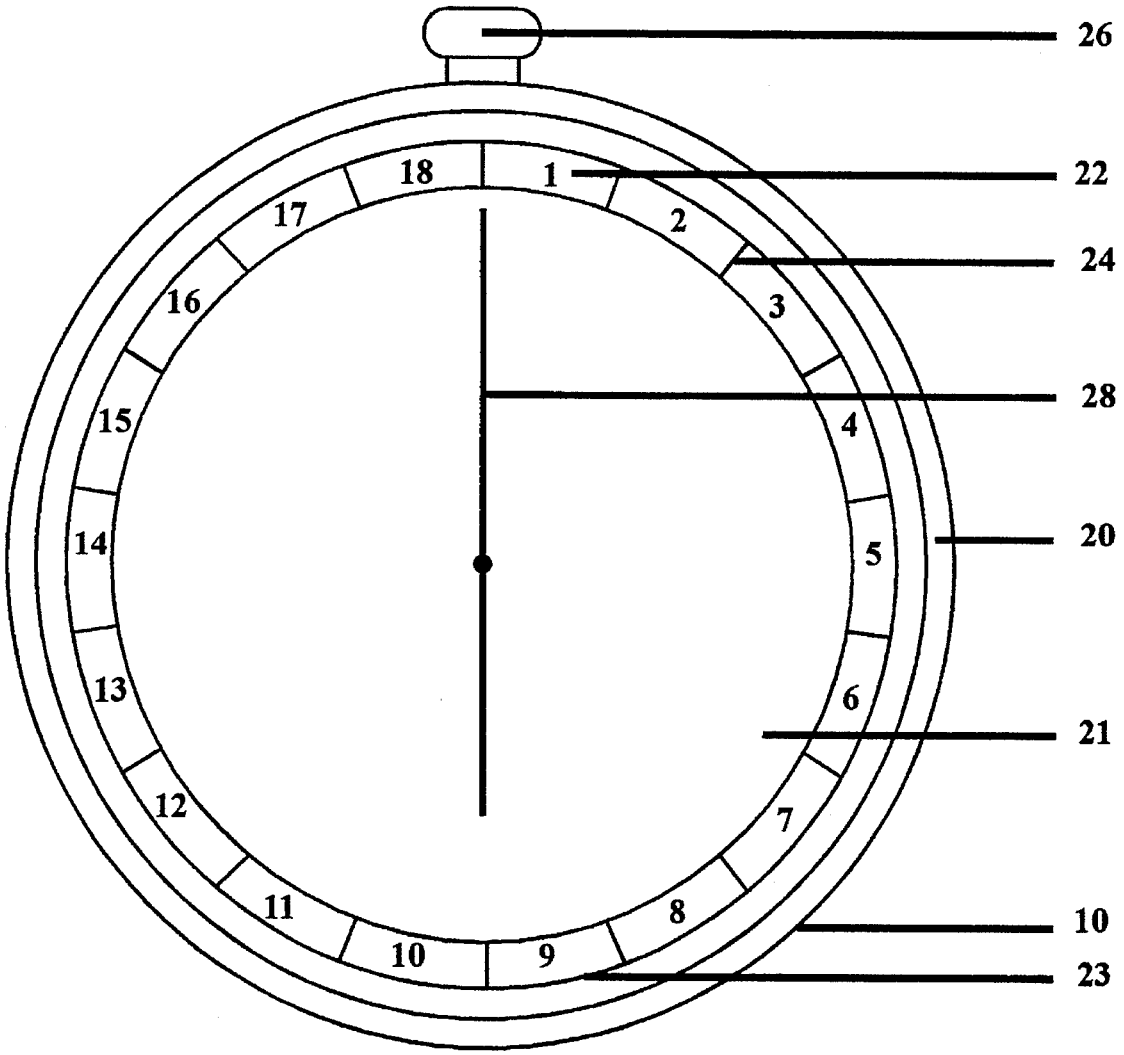
FIG. 1 is a front view of a first embodiment of the present invention.

Referring to FIG. 1, a first embodiment of the timer 10 of the present invention is illustrated. The timer has a case 20 with a face or dial 21. Inside the timer is a conventional timing mechanism, not shown, for rotating main hand 28 in a clockwise direction. The dial 21 has a series of numbers 22, each of which corresponds to a hole on the golf course.

In the first embodiment of the timer 10 shown in FIG. 1 the numbers 22 are providing around the circumference of the dial 21, and are positioned inside of equally sized arcuate segments of circular ring 23. The first embodiment has eighteen holes, corresponding to the typical number of holes on a golf course. Each number 22 is positioned in an arcuate segment 23 so that it is preceded by a line 24. The lines 24 represent the tees for each of the holes. Therefor, the line 24 preceding the numeral 1 of the dial 21, represents the first tee, the line 24 preceding the numeral 2, represents the second tee, and so on.

In use, the golfer sets the duration of a the desired number of holes to played, in a manner to be described later. The time it takes for the main hand 28 of the timer 10 to complete a single rotation will equal the set duration for the round of golf. The main hand 28 starts at the twelve o'clock position at the line 24 between numerals 18 and 1, which represents the first tee. When the golfer or golfers are ready to begin playing their round the start/stop/reset button 26 is depressed to start the main hand 28 rotating clockwise.

When the main hand reaches the line 24 between the numerals 1 and 2 the golfer or golfers should be at the second tee. The timer 10 is meant to be a rough guide, and provides a general indication of where one should be on the course at a given time. By the third hole, the player should not be more than plus or minus one hole from the hole indicated on the timer 10. If the golfer or golfers arrive at the second tee after the main hand 28 has passed the line 24 between numerals 1 and 2 the golfer(s) will have an approximate indication that they might be playing too slowly and that they must pick up their pace in order to finish the course in the desired time period. Similarly, if the golfer(s) reach the second tee before the main hand 28 reaches the line corresponding to the second tee, they will have an indication that they might be ahead of schedule and have achieved a slight leeway in case they subsequently hit a hole that is slow for them.

When the demand for playing time is at a maximum, fast play can be just as much as a problem as slow play. Therefore, if a golfer or golfers reach a tee before the main hand 28 reaches the corresponding tee numeral 22 on the dial 21, they are provided with feedback letting them know that they should consider slowing down their play or risk interfering with a group playing ahead of them.

Figure 2:
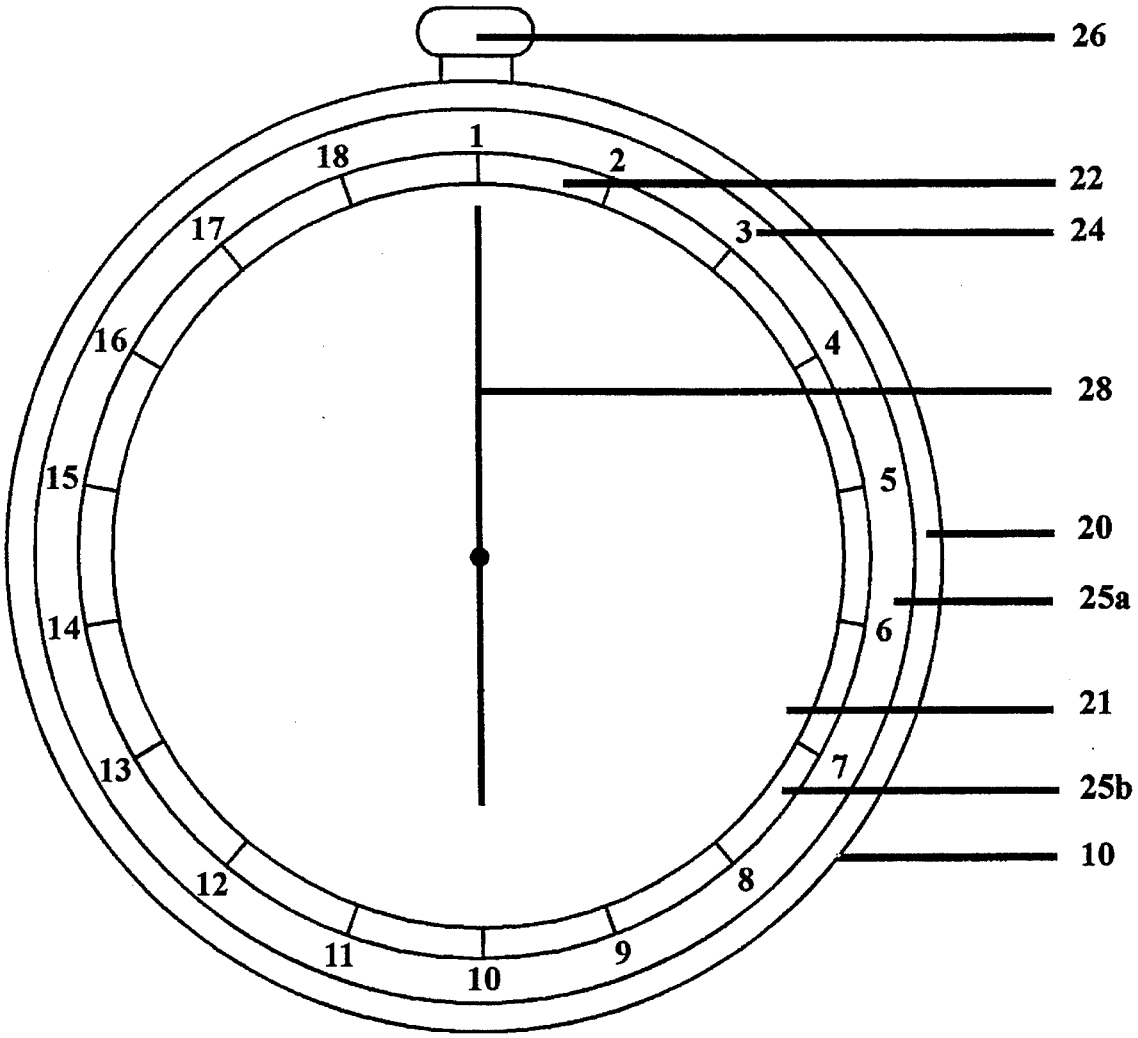
FIG. 2 is a front view of a second embodiment of the present invention.
Figure 3:
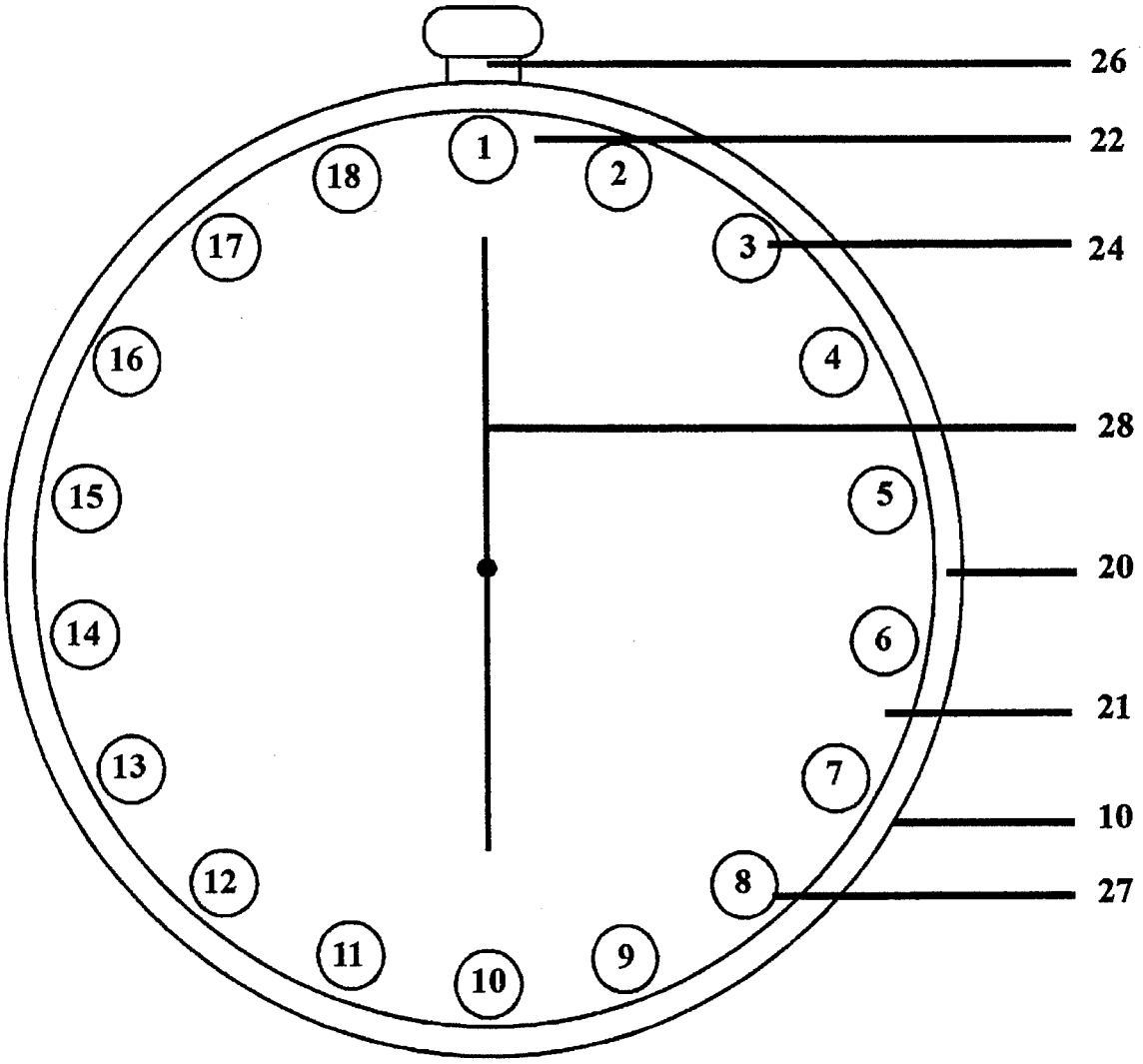
FIG. 3 is a front view of a third embodiment of the present invention.
Figure 4:
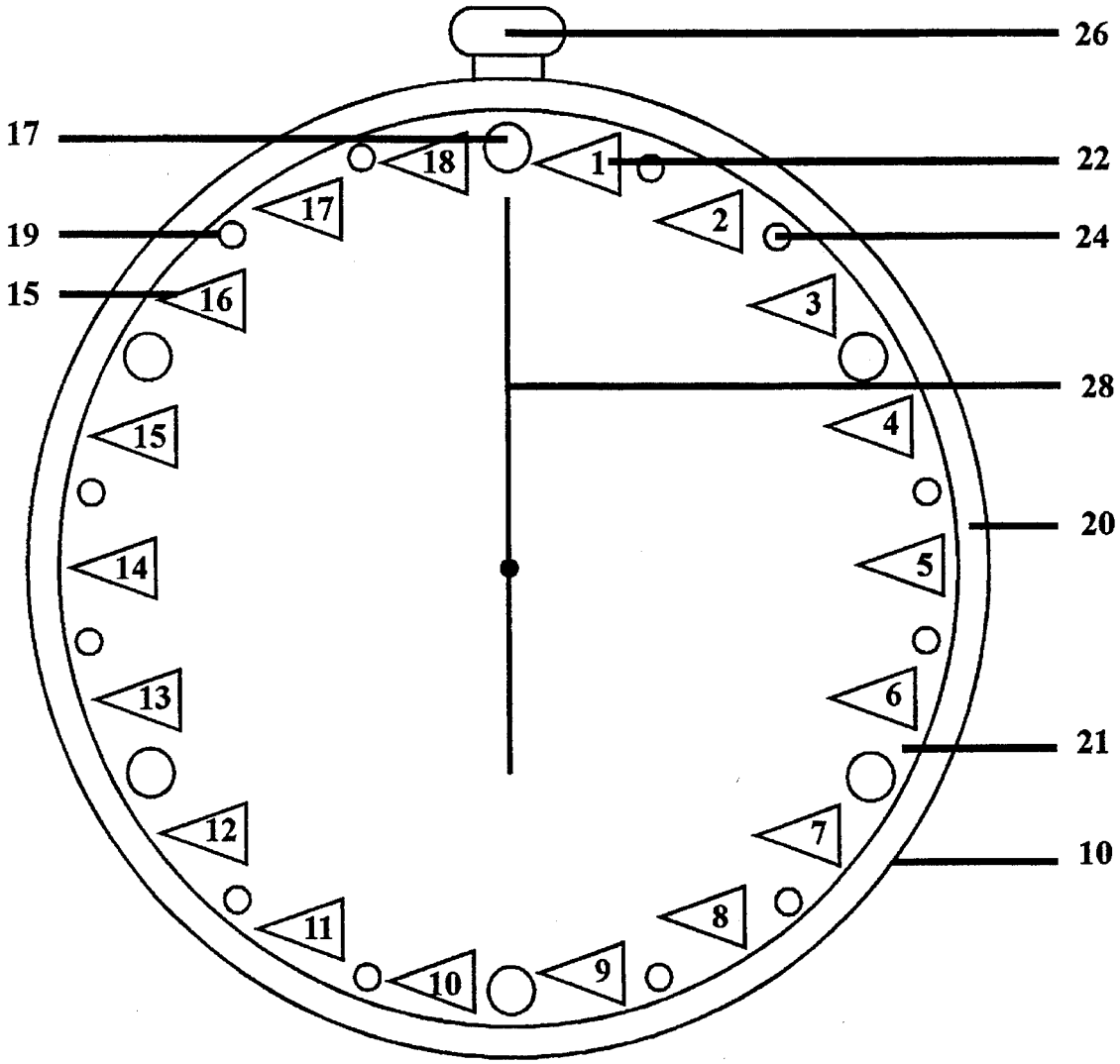
FIG. 4 is a front view of a fourth embodiment of the present invention.

FIGS. 2, 3, and 4 illustrate second, third, and fourth embodiments of the present invention, respectively. The primary difference between the first, second, third, and fourth embodiments of the invention are the configurations of the numerals 22, the tee representations, hole representations, and the pattern of configuration of the dial 21.

Referring to FIG. 2, the second embodiment differs from the first in that the numerals 22 corresponding to the holes are provided in an outermost ring 25*a*, while the tee markers are provided in an inner ring 25*b*. Lines 24 representing the various tees are provided in inner ring 25*b*.

In the third embodiment, shown in FIG. 3, no rings are provided on the dial 21. Instead each numeral 22 is surrounded by circle 27. In operation, when the main hand 28 points to a specific numeral 22, that indicates that the golfer should be teeing off at that time. If the golfer is either ahead or behind the appropriate tee, indicated by the timer, he or she should slow down or speed up their play, accordingly.

FIG. 4 illustrates the fourth embodiment of the invention, in which the golfer receives indications of which hole he should be on, when he should be at the tee, and when he should reach the green. The numerals 22 are surrounded by triangles 15, representing golf hole flags. Each triangle 15 is preceded by a circle 17 representing the tee for that hole. As the main hand 28 rotates, when it points to a large circle 17, the golfer should be at the approximately corresponding tee on the course. The circles 19 preceding the 4th, 7th, 10th, 13th and 16th tees are larger than circles 17. Since the timer 10 is intended to give only a general indication of where a golfer should be at a given moment, larger circles 15 are provided to remind the golfer to check his progress at these holes. It is the golfer's progress over a group of holes that is most important, and not the precise tracking of progress at every tee.

Figure 5:
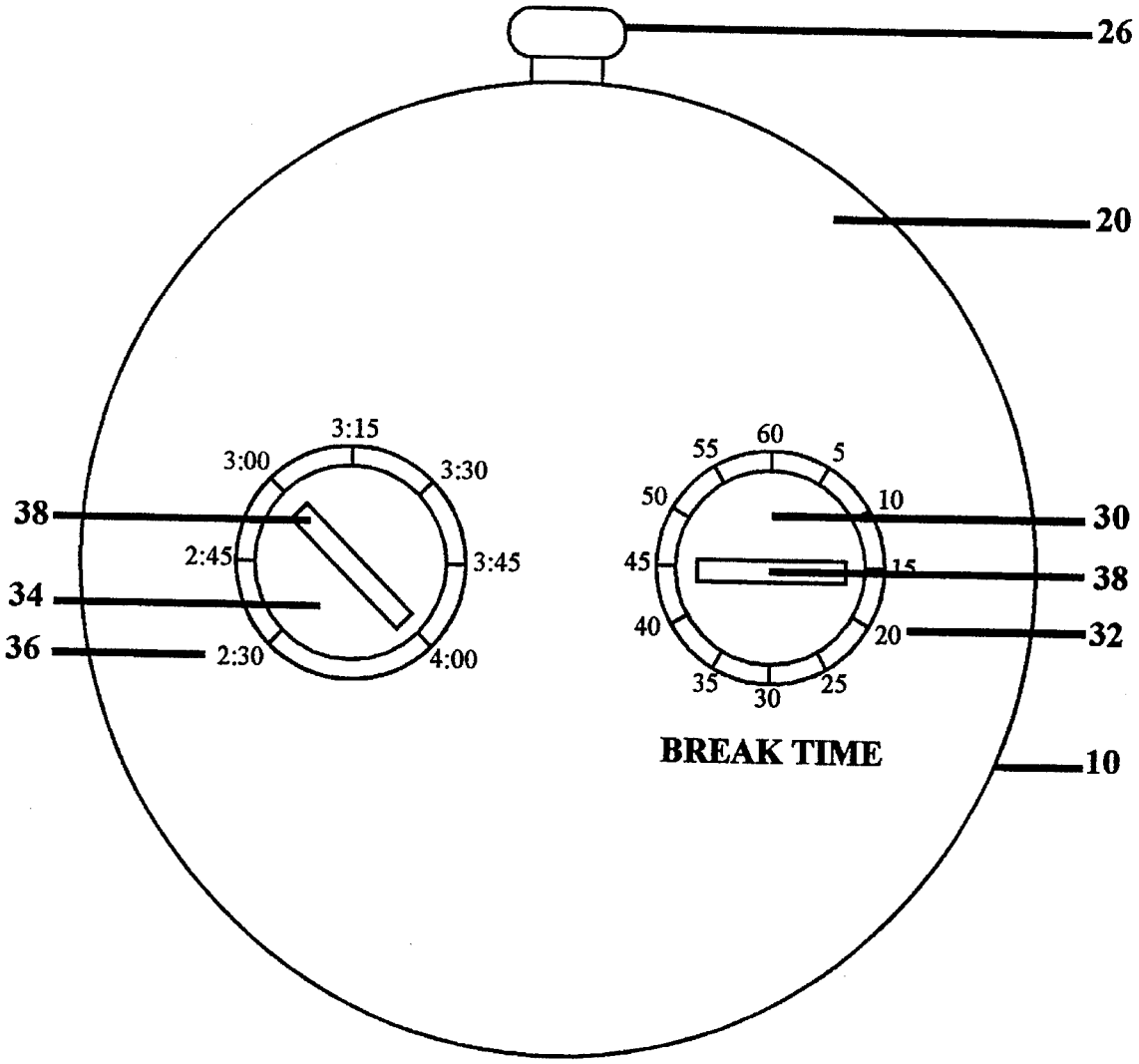
FIG. 5 is a rear view of a fifth embodiment of the present invention.

Referring now to FIG. 5, the rear of a fifth embodiment is depicted. The desired time for a round of golf can be adjusted by the mechanism 34 on back face of the case 20. The mechanism 34 is circular and has a series of durations provided around its circumference. In the illustrated example seven durations 36, 2 hours and 30 minutes, 2 hours and 45 minutes, 3 hours, 3 hours and 15 minutes, 3 hours and 30 minutes, 3 hours and 45 minutes, and 4 hours, are provided as choices. To select one of the durations a coin or other thin device is inserted in the slot 38 and the mechanism is rotated to the desired duration.

The selected duration can be affected by a number of factors, such as the weather, the course condition, the number of players on the group, the degree to which the course is crowded, and the equipment, such as carts, that is used. These and other considerations can thus be employed when setting the duration of the timer 10. In this way the timer 10 of the present invention is more flexible than the prior devices. yWhile the embodiments of FIGS. 1–4, would only have a duration adjustment mechanism on the back face, FIG. 5 also shows a break time adjustment mechanism 32. It is often desirable to take a break at some point during a round of golf. The common point in the round is after the ninth hole, but could be at some other point. The timer 10 shown in FIG. 5 accommodates such a break and includes an additional mechanism 32 so that the user can keep track of the break time. The mechanism 32 is a separate timer built into the timer 10, and is circular. The break can be adjusted from 5 to 60 minutes, in five minute intervals by rotating the mechanism 32. The mechanism 32 has a slot 38 just like the slot 38 in the duration mechanism 34, and is adjusted in a similar manner by inserting a coin or other thin device into the slot and rotating.

Figure 6:
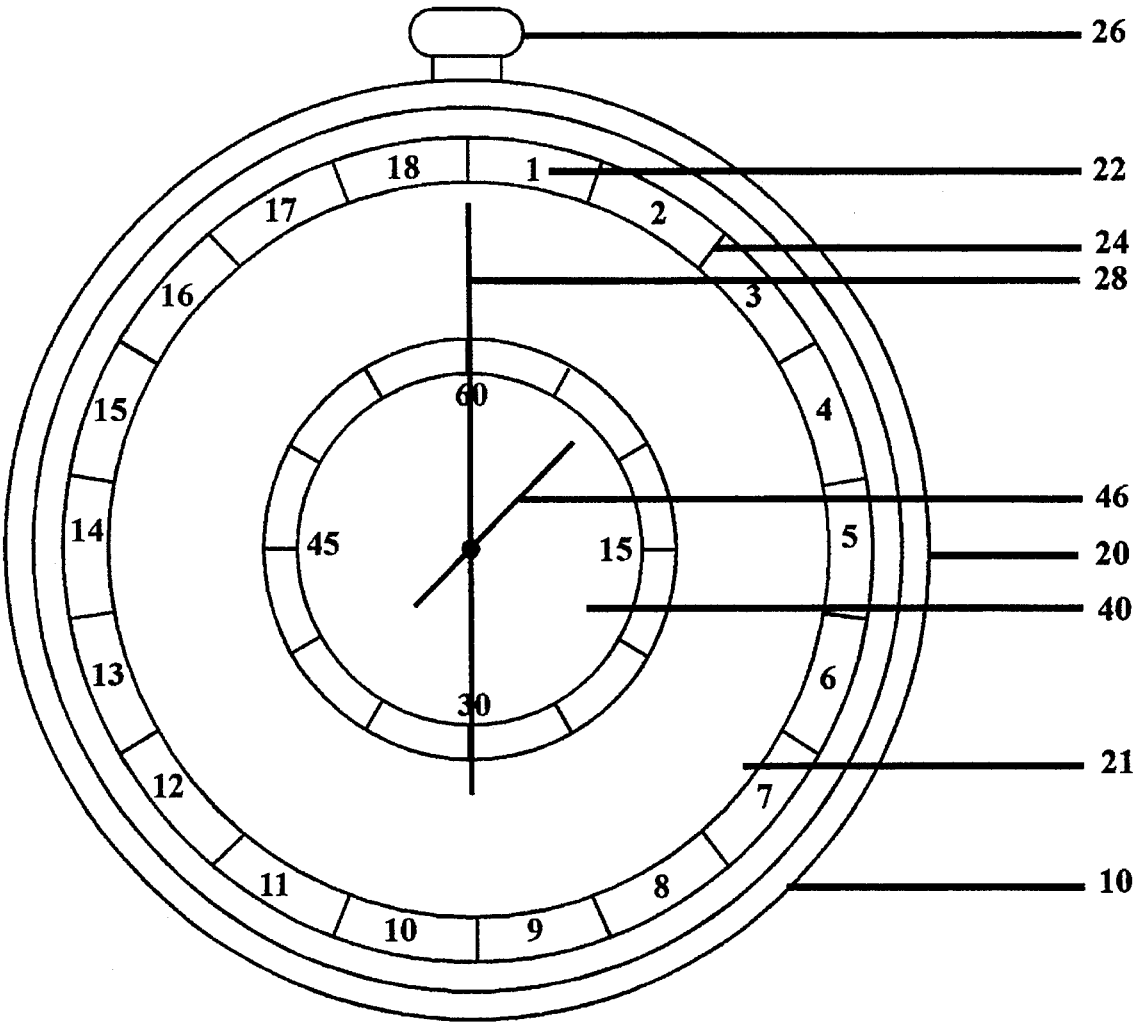
FIG. 6 is a front view of the embodiment shown in FIG. 5.

The front face of the timer 10 shown in FIG. 5 is illustrated in FIG. 6. In this embodiment, the duration portion of the timer is identical to the embodiment illustrated in FIG. 1, and all of the same components bear the same reference numbers. A break time dial 40 is provided in the center of the dial 21. A break time hand 46 rotates clockwise to shown the amount of elapsed break time. The break time dial 40 is a 60 minute timer in the illustrated embodiment, and the main hand 28 and the break time hand 46 rotate about the same axis.

The start/stop/reset button 26 can be employed to operate both the duration timer and the break timer. For example, the timer 10 can be designed so that the break timer automatically engages when the duration timer is disengaged. Similarly, the duration timer can begin operating at the completion of the set break time. Alternately, a separate break time start/stop/reset mechanism can be employed.

Figure 7:
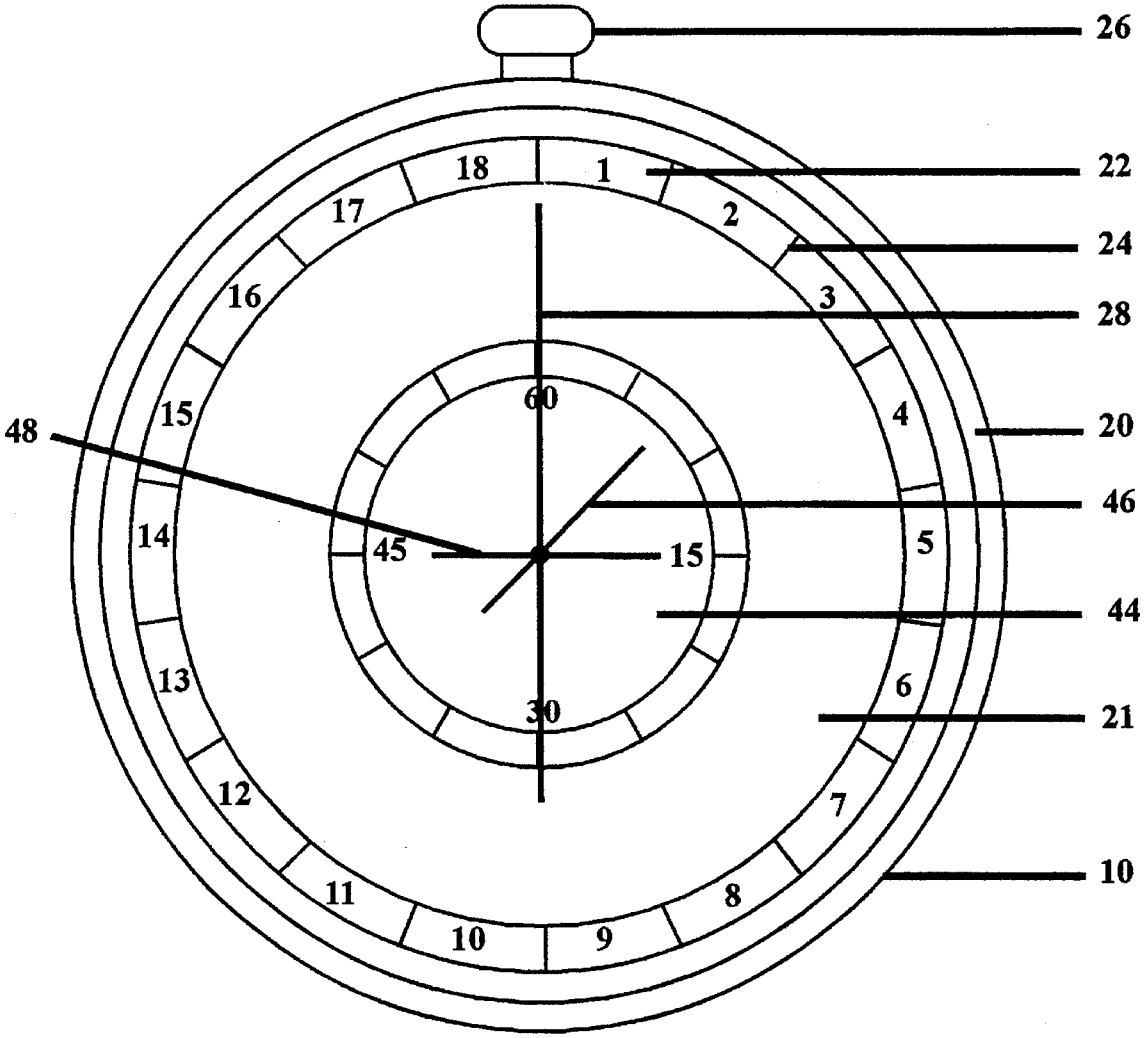
FIG. 7 is a front view of a sixth embodiment of the present invention.

A sixth embodiment of the present invention is illustrated in FIG. 7, and is similar to the embodiment shown in FIG.

6, but also includes a mechanism to keep track of extra time. In the event that a golfer or group requires extra time to complete a round of golf, an extra time hand 48 is provided. Hand 48 rotates clockwise about the same axis as the hands 28 and 46, and can track up to 60 minutes of extra time. Thus, once the main hand 28 completes its rotation, the extra time hand will begin rotation. The golfer will then have an indication of how much additional time was required to finish the round.

Figure 8:
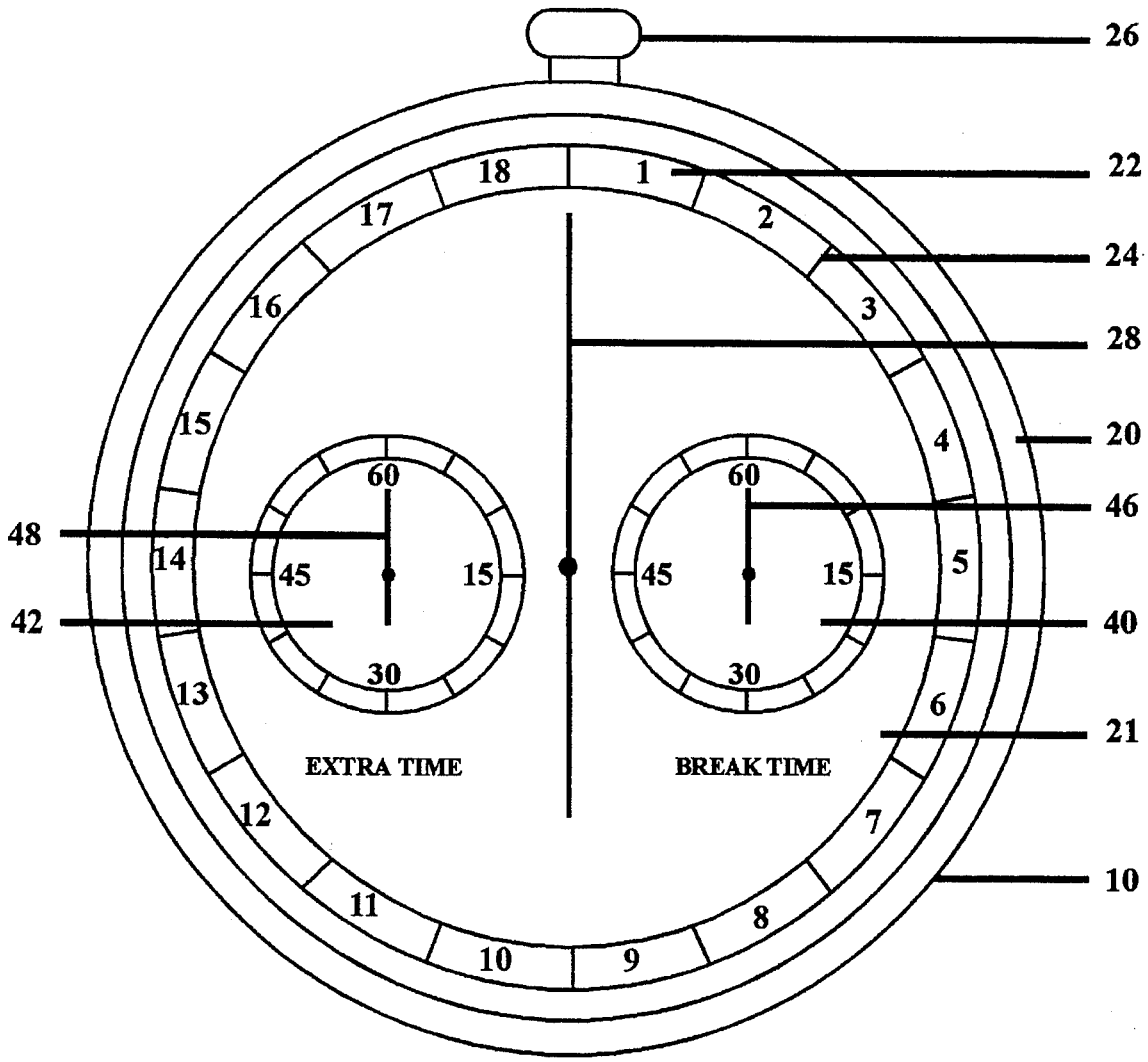
FIG. 8 is a front view of a seventh embodiment of the present invention.

An alternate arrangement of the device of FIG. 7 is shown in FIG. 8, where separate dials 21, 40 and 42 are provided for each of the duration timer, the break timer and the extra timer, respectively. In this embodiment, the hands 28, 46, and 48 rotate about different axes.

Figure 9:
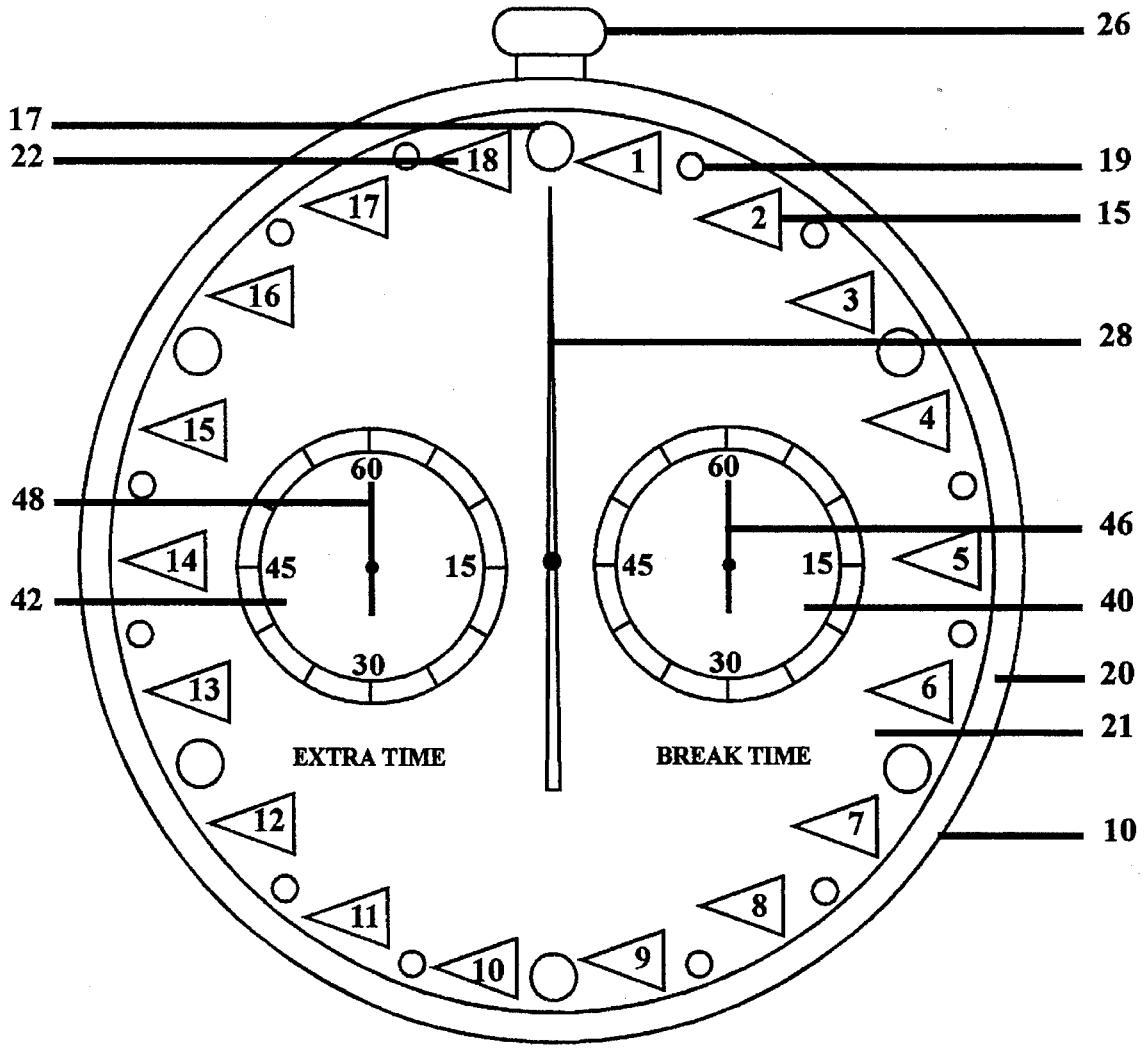
FIG. 9 is a front view off a eight embodiment of the present invention.
Figure 10:
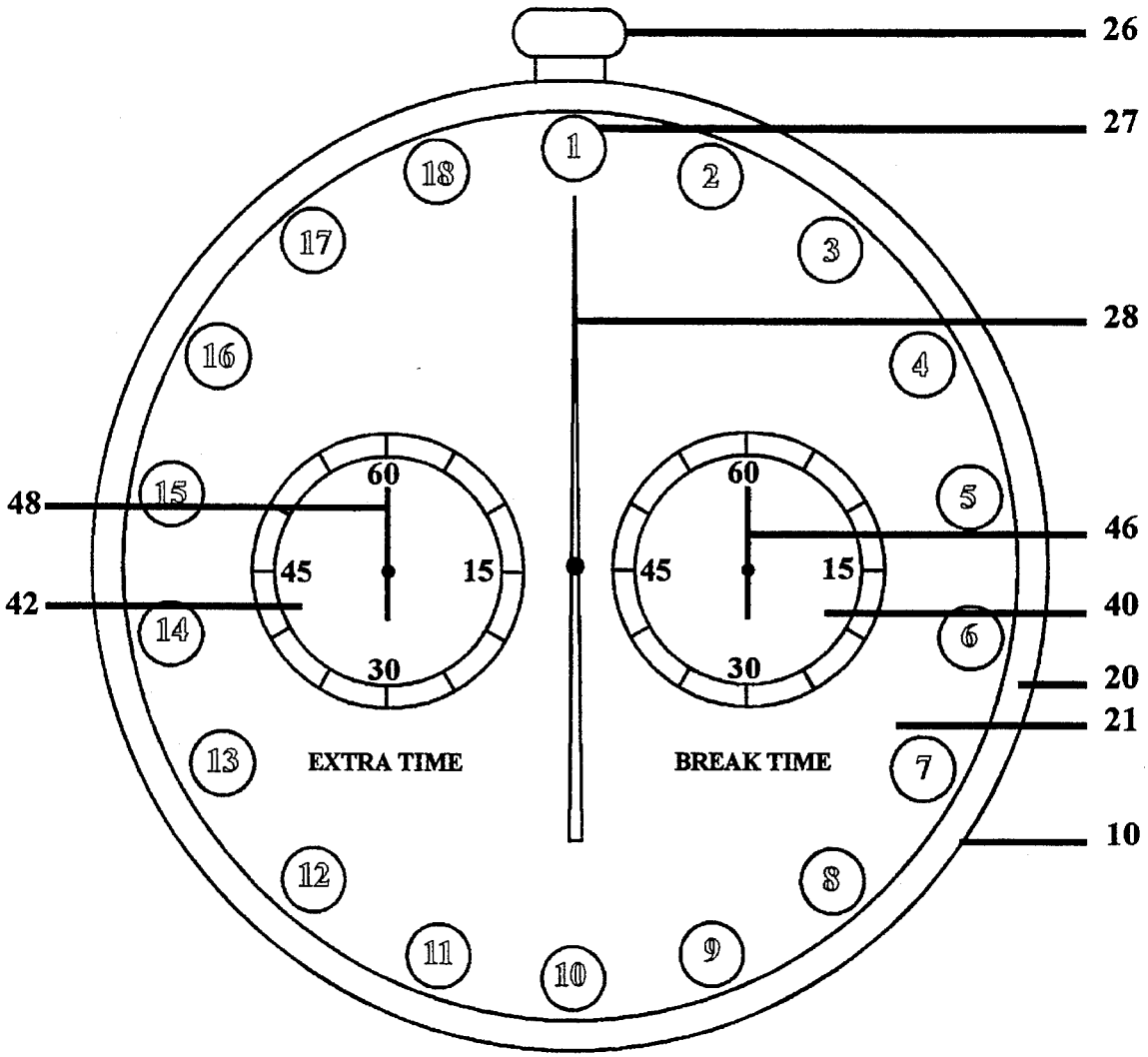
FIG. 10 is a front view of a ninth embodiment of the present invention.

FIGS. 9 and 10 show embodiments similar to the one shown in FIG. 8 with separate break and extra timer dials, but the duration timer dial 21 has the configurations shown the embodiments of FIGS. 4 and 3, respectively.

Having described several embodiments of the in accordance with the present invention, it is believed that other modifications, variations and changes will be suggested to those skilled in the art in view of the description set forth above. For example the number of holes and time durations shown in the illustrated embodiments are meant to be common values, and are not meant to be limited to those values. It is therefor to be understood that all such variations, modifications and changes are believed to fall within the scope of the invention as defined in the appended claims.

What is claimed is:

1. A device for timing golf play comprising:

a dial having numbers corresponding to the number of holes on a golf course, said numbers being spaced at uniform intervals around said dial;

means for adjusting a desired duration period for a round of golf;

a first rotating hand for indicating one of said numbers corresponding to one of said holes a golfer should be at, at a given time, in order to complete said round of golf in said desired duration period;

means for rotating said first rotating hand one complete rotation in said desired duration period;

means for starting, stropping and resetting said rotating means wherein said adjusting means adjusts said desired duration period by changing the time it takes said first rotating hand to complete a single rotation.

2. A device for timing golf play as recited in claim 1, further comprising means for indicating when a golfer should be at a particular tee of one of said holes on said course.

3. A device for timing golf play as recited in claim 2, further comprising means for indicating when a golfer should be at a particular green of one of said holes on said course.

4. A device for timing golf play as recited in claim 2, wherein said means for indicating when a golfer should be at a particular tee comprises a ring of arcuate segments, each segment being desposed near one of said numbers, and a wherein a radial line preceding each of said numbers corresponds to a tee for said hole corresponding to said number.

5. A device for timing golf play as recited in claim 4, wherein said each of said ring of arcuate segments surrounds one of said numbers.

6. A device for timing golf play as recited in claim 1, wherein said means for adjusting a desired duration period for a round of golf is disposed on a back of said device.

7. A device for timing golf play as recited in claim 1, wherein said means for adjusting a desired duration period for a round of golf comprises means for adjusting said duration period to lengths varying by fifteen minute intervals.

8. A device for timing golf play as recited in claim 1, further comprising means for tracking a break time in said golf play.

9. A device for timing golf play as recited in claim 8, wherein break time tracking means comprises:

means for adjusting the duration period of said break time, a dial showing said break time, and a break time hand for illustrating said elapsed break time.

10. A device for timing golf play as recited in claim 9, wherein said break time dial and said dial showing said course holes are concentric, and said break time hand and said first rotating hand rotate about a same axis.

11. A device for timing golf play as recited in claim 9, wherein said break time dial is disposed on said dial showing said course holes, and wherein said break time hand and said first rotating hand rotate about different axes.

12. A device for timing golf play as recited in claim 9, further comprising a means for tracking extra time for completing play on said course when said duration period for a round of golf expires.

13. A device for timing golf play as recited in claim 12, wherein said extra time tracking means comprises:

a dial showing said extra time, and an extra time hand for indicating said elapsed extra time.

14. A device for timing golf play as recited in claim 13, wherein said means for tracking extra time comprises a dial disposed on said dial showing said course holes, and said break time dial, said extra time dial and said dial showing said course holes are concentric, and wherein said break time hand, said extra time hand and said first rotating hand rotate about a same axis.

15. A device for timing golf play as recited in claim 13, wherein said means for tracking extra time comprises a dial disposed on said dial showing said course holes, and said break time dial, said extra time dial and said dial showing said course holes are separate from one another, and wherein said break time hand, said extra time hand and said first rotating hand rotate about different axes.

16. A device for timing golf play as recited in claim 8, wherein said duration period of said break time can be adjusted up to sixty minutes.

17. A device for timing golf play as recited in claim 8, wherein said break time tracking means automatically engages when said means for rotating said first hand one complete rotation is disengaged.

18. A device for timing golf play as recited in claim 1, further comprising a means for tracking extra time for completing play on said course when said duration period for a round of golf expires.

* * * * *